US009863091B2

(12) United States Patent
Etschmaier et al.

(10) Patent No.: US 9,863,091 B2
(45) Date of Patent: Jan. 9, 2018

(54) ROLL

(71) Applicant: VOITH PATENT GMBH, Heidenheim (DE)

(72) Inventors: Alexander Etschmaier, Neuberg (AT); Franz Grohmann, Kueb (AT)

(73) Assignee: Voith Patent GmbH, Heidenheim (DE)

( * ) Notice: Subject to any disclaimer, the term of this patent is extended or adjusted under 35 U.S.C. 154(b) by 152 days.

(21) Appl. No.: 14/889,546

(22) PCT Filed: Mar. 11, 2014

(86) PCT No.: PCT/EP2014/054651

§ 371 (c)(1),
(2) Date: Nov. 6, 2015

(87) PCT Pub. No.: WO2014/180588

PCT Pub. Date: Nov. 13, 2014

(65) Prior Publication Data

US 2016/0130756 A1 May 12, 2016

(30) Foreign Application Priority Data

May 6, 2013 (DE) ..... 10 2013 208 254

(51) Int. Cl.
*D21F 3/08* (2006.01)
*D21G 1/02* (2006.01)

(52) U.S. Cl.
CPC ..... *D21F 3/08* (2013.01); *D21G 1/0246* (2013.01)

(58) Field of Classification Search
CPC ..... D21F 3/08; D21G 1/0246; B23K 26/342; B23K 26/0081; B23K 26/352; B23K 26/354; B23K 5/18; B23K 15/0086; B23K 2201/35
See application file for complete search history.

(56) References Cited

U.S. PATENT DOCUMENTS 3,526,939 A * 9/1970 Nikkanen ..... B21B 28/02 241/293
4,015,100 A * 3/1977 Gnanamuthu ..... B23K 26/34 148/512
4,064,608 A 12/1977 Jaeger
4,323,756 A * 4/1982 Brown ..... B22F 3/006 219/121.66
4,484,959 A * 11/1984 Boucher ..... B21B 27/00 148/524

(Continued)

FOREIGN PATENT DOCUMENTS

CN 1037371 A 11/1989
CN 1435531 A 8/2003

(Continued)

*Primary Examiner* — Jason L Vaughan
(74) *Attorney, Agent, or Firm* — Laurence A. Greenberg; Werner H. Stemer; Ralph E. Locher

(57) ABSTRACT

A roll for use in a machine for producing and/or further processing a fibrous web, such as a paper, paperboard, or tissue web, includes a roll cover having at least some sections or regions formed of a metal material and a coating formed on the roll cover. The coating is formed of a metal, ceramic and/or cermet material, or at least some sections or regions of the coating include one of those materials. An alloy region is situated between the roll cover and the coating.

14 Claims, 1 Drawing Sheet

(56) References Cited

U.S. PATENT DOCUMENTS

| | | | | | |
|---|---|---|---|---|---|
| 4,609,577 | A * | 9/1986 | Long | B23K 35/3086 | 420/34 |
| 4,733,446 | A * | 3/1988 | Kuroki | B21B 27/00 | 492/1 |
| 4,748,736 | A * | 6/1988 | Miihkinen | D21F 3/08 | 219/76.1 |
| 4,772,773 | A * | 9/1988 | Hashimoto | B23K 15/0086 | 219/121.14 |
| 4,847,112 | A | 7/1989 | Halleux | | |
| 4,856,161 | A | 8/1989 | Miihkinen | | |
| 4,942,059 | A * | 7/1990 | Wilson | B23K 35/32 | 148/224 |
| 4,989,306 | A | 2/1991 | Leino et al. | | |
| 5,111,567 | A | 5/1992 | Leino et al. | | |
| 5,235,747 | A * | 8/1993 | Leino | C23C 4/02 | 29/895.32 |
| 5,308,409 | A * | 5/1994 | Kamimura | B23K 9/04 | 148/512 |
| 5,766,378 | A * | 6/1998 | Horn | C21D 9/50 | 148/526 |
| 5,967,959 | A | 10/1999 | Niemi et al. | | |
| 6,127,644 | A * | 10/2000 | Singh | B23K 9/048 | 219/73.11 |
| 6,200,248 | B1 | 3/2001 | Vestola et al. | | |
| 6,843,866 | B2 * | 1/2005 | Brenner | B23K 10/027 | 148/525 |
| 2001/0024723 | A1 | 9/2001 | Vestola et al. | | |
| 2006/0054079 | A1 * | 3/2006 | Withey | C30B 29/02 | 117/108 |

FOREIGN PATENT DOCUMENTS

| | | | |
|---|---|---|---|
| DE | 2744188 | A1 | 4/1978 |
| DE | 3621154 | A1 | 3/1987 |
| DE | 3725892 | A1 | 2/1989 |
| EP | 0278942 | A1 | 8/1988 |
| EP | 0425454 | A1 | 5/1991 |
| EP | 0425464 | A1 | 5/1991 |
| EP | 0870867 | A2 | 10/1998 |
| EP | 0870868 | A2 | 10/1998 |

* cited by examiner

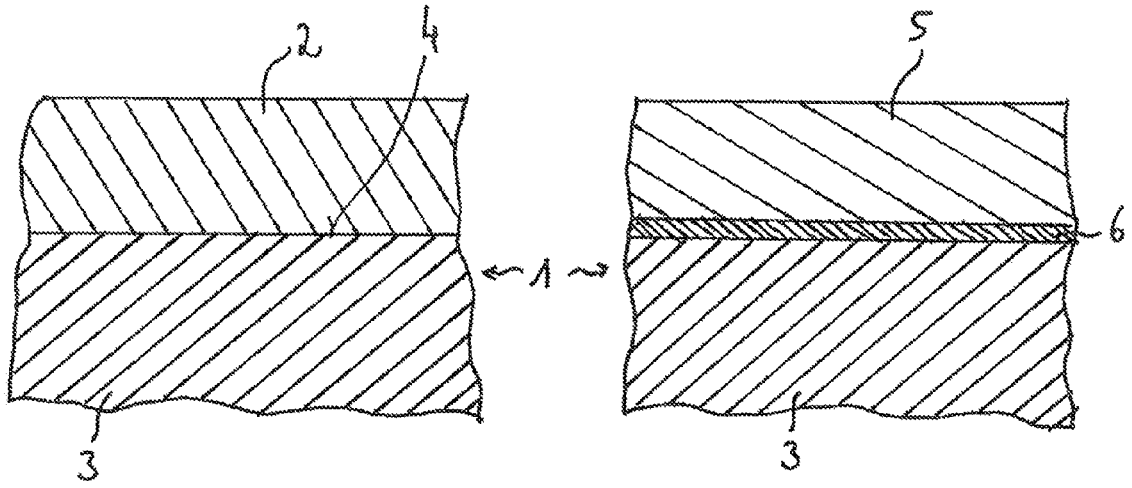
FIG. 1A
PRIOR ART
FIG. 1B
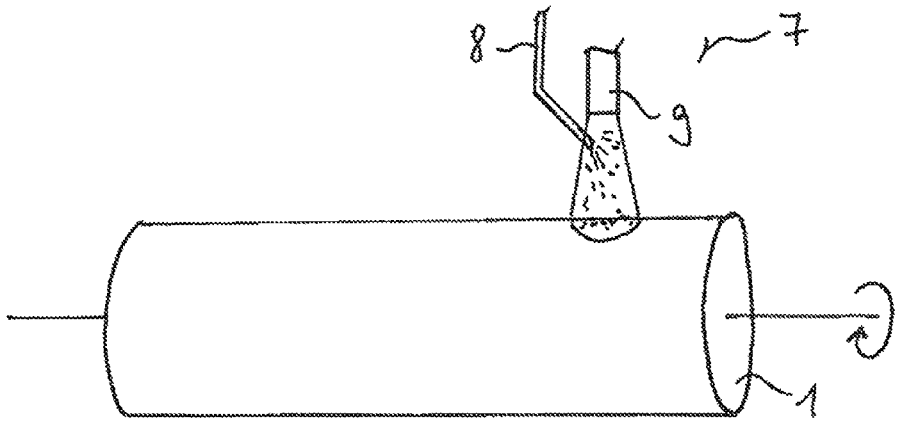
FIG. 2

ROLL

BACKGROUND OF THE INVENTION

Field of the Invention

The invention is based on a roll, in particular for use in a machine for producing and/or finishing a fibrous web such as a paper, board or tissue web, including a roll shell having at least some sections formed of a metal material and a coating formed thereon.

Rolls of this type are present in a multiplicity of positions and with a multiplicity of functions in the aforementioned machines. For example, rolls having soft covering layers are suitable for pressing and dewatering the fibrous web, rolls with hard surfaces, in particular including those with a heating device, are primarily used for calendering and drying.

The last-named rolls were earlier often produced from granite and ground with high quality. More recent concepts provided steel rolls, which were likewise polished. Since these rolls all have various disadvantages, such as, for example, the high weight in the case of granite rolls or the susceptibility to corrosion in the case of steel rolls, novel methods for coating roll bodies made of steel or of composite materials have become widespread over time, said methods forming a metallic, ceramic or cermet sprayed layer by means of methods such as HVOF or flame spraying on the roll body. Rolls of this type have been known for a relatively long time and form the current prior art, for example in the case of central press rolls, drying cylinders and guide rolls.

The thermal coating process provides for powder or wires to be melted by means of the input of thermal energy and accelerated kinetically onto the roll core to be coated. The properties and possibilities of the spraying processes are substantially given by the ratio of the kinetic to the thermal energy.

A roll having a coating made of a metal oxide is known, for example from EP 0 870 867 B1. There, a description is given of a roll for a paper machine, board machine or a finishing machine, having a ceramic layer with a thickness of 100 to 2000 μm which is applied to the surface of the roll, the roughness Ra of the outer surface of the roll being 0.2 to 2.0 μm and preferably 0.4 to 1.5 μm. The ceramic layer has 50 to 95% and preferably 55 to 80% of $Cr_2O_3$ and 3 to 50% and preferably 20 to 45% of $TiO_2$ and possibly other metal oxides.

The known methods and the metallic, ceramic or cermet coatings that can be produced thereby are afflicted with various disadvantages.

Firstly, as a result of the sole input of energy into the material to be applied and a cooling rate of up to $10^6$ K/s, only a mechanical connection or bonding of the raw material on the roll core occurs. In order to configure this bonding as effectively as possible, careful preparatory surface treatment such as sandblasting and the like is necessary, which is complicated and time-consuming.

Secondly, the coating structure, depending on the material and/or production process, is sealed porous as far as open porosity. The porosity can lead to an increased tendency to corrosion and to adhesion problems. Accordingly, the surface of the sprayed layer must be filled, for example by means of final sealing, with a polymer.

Furthermore, thermal spraying is not an economical or an ecological method, because of the poor application efficiency of the powder with regard to the microns per pass and the percentage of powder remaining on the roll.

BRIEF SUMMARY OF THE INVENTION

It is accordingly an object of the invention to specify a roll the coating of which, with regard to the adhesion thereof to the roll core and the corrosion resistance thereof, satisfies the requirements which are placed by paper, board or tissue machines with regard to temperatures, moisture and loading by chemicals.

The object is achieved by a roll for use in a machine for producing and/or further processing a fibrous web such as a paper, board or tissue web, including a roll shell having at least some sections formed of a metal material and a coating formed thereon.

According to the invention, provision is made for there to be a coating which is made of a metallic, ceramic and/or a cermet material, or for at least some sections of said coating to comprise one of said materials, an alloy region being formed between the roll shell and the coating.

Further advantageous refinement variants and aspects of the invention emerge from the sub-claims.

Provision can preferably be made for the alloy region to have a thickness of 0.5 to 3%, preferably of 1%, of the layer thickness of the coating.

According to an advantageous aspect of the invention in the alloy region there can be a metallurgical connection between the material and the material of the roll shell.

The coating can preferably be produced by using an inductive device, a plasma gun or a laser.

The material can advantageously be present in powder form, in rod form or as wire.

According to advantageous aspects of the invention, the coating can have at least one layer which is produced by a single pass, or preferably a plurality of layers which are produced by a plurality of passes.

BRIEF DESCRIPTION OF THE SEVERAL VIEWS OF THE DRAWING

The invention will be described in more detail below with reference to the drawings, without restricting the generality. In the figures:

FIGS. 1A-1B show a highly schematic sectioned view through a thermal sprayed layer and a coating according to the invention, and FIG. 2 shows a highly schematic illustration of the application of a coating according to the invention.

DESCRIPTION OF THE INVENTION

In FIG. 1, for the purpose of easier orientation, a thermal sprayed layer according to the prior art (FIG. 1A) is compared with a coating (FIG. 1B) according to the invention produced by laser cladding.

The basic task of a roll coating, depending on the position in the paper, board or tissue machine, can extend from "only wear-resistant" as far as "only corrosion-resistant". The common factor in all positions, however, is a requirement for good adhesion of the roll coating to the roll core. The disadvantages listed further above can be ameliorated by improved adhesion of the coating to the roll core to the extent that the attachment of the coating material is not based on purely mechanical bonding but on a metallurgical bond.

By means of this "true" adhesion, which must be present only in a range from 0.5 to 3% of the layer thickness, an increase in the adhesive tensile strength by up to 80% as compared with a thermal sprayed layer can be achieved.

Depending on the position, this increase in the adhesion primarily provides an increased running time, in the area of safety in the event of fabric tears and other, also local, overloads.

In combination with the improved adhesion with a reduced porosity of the coating, the corrosion resistance can additionally be increased as compared with a conventional thermal sprayed layer.

If FIG. 1 is considered, a detail from a roll 1 having a conventional thermal sprayed layer 2 is illustrated in highly schematic sectioned form in the left-hand illustration, FIG. 1A. The sprayed layer 2 is applied to a roll body 3 which consists of metal, preferably of steel.

As explained further above, the sprayed layer 2 can at least partly consist of metallic, ceramic or cermet materials. The attachment of the materials to the roll shell 3 is carried out only by mechanical or form-fitting bonding of the molten particles to the material of the appropriately prepared roll shell 3. The interface 4 formed in this way has no significant extent, viewed in the radial direction. The adhesion is thus limited. In particular in the event of corrosion by water migrating underneath and in the event of point-like mechanical overloads, such as, for example, during the passage of a foreign body through a nip between two rolls 1, it is therefore necessary to take account of the fact that some areas of the sprayed layer 2 will be detached from the roll shell 3. This can lead to endangering the operating personnel and to damaging following machine parts.

By comparison, in the same view as FIG. 1A, FIG. 1B illustrates a cross section through a coating 5 produced in accordance with the invention by means of laser cladding. The attachment to the surface of the roll shell 3 of the materials which are built up to form the coating 5 is present to an intensified extent here, since the input of energy is higher overall and not only are the materials molten but thermal energy is also put into the surface of the roll shell 3. As a result, the roll shell 3 is melted to a small extent, so that the material, which is applied by means of a suitable application device, is able to form an alloy with the material of the roll shell, and thus enters into a metallurgical connection with the material of the roll shell 3. Here, the kinetic energy thus barely contributes to the coating process, as opposed to thermal spraying.

Here, it is sufficient if an alloy region 6 makes up about 0.1 to 3%, preferably 1%, of the layer thickness of the coating 5 that is to be built up.

This is to be judged as positive in view of the likewise known method of application welding. Firstly, the alloy region 6 is smaller, so that finer processing of the materials is possible, which improves the surface quality of the coating 5 and reduces subsequent operations.

Secondly, the coating 5 produced by the laser cladding is normally produced in several passes, an alloy region likewise being produced again between the layers of the individual passes, since each time the region lying underneath is melted again and forms an alloy with the further layer lying thereon. This results in turn in adhesion and corrosion resistance which are increased.

The structure of a coating 5 on a roll 1 is illustrated in a highly schematic view in FIG. 2.

Here, the roll 1 is supported such that it can rotate and is driven suitably, so that it rotates underneath an application device 7 that can preferably be displaced axially along the roll 1. As a result, the entire surface of the roll 1 can be coated in a continuous spiral line in at least one or more passes. However, it is also possible to apply the coating 5 in another way, for example in radial rings or axial stripes. The application device 7 substantially comprises a material feed 8 and an energy source 9, into which the usually powdery material is put.

Conceivable as the energy source 9 are inductive and plasma-generating devices and lasers of various types such as $CO_2$ lasers, HDPL (high-power diode lasers) or DDL (direct diode lasers). Building up a coating 5 by means of laser cladding constitutes the technologically most easily implemented variant.

A great economic advantage of the method is to be seen in the high deposition efficiency as compared with thermal coatings, with an increased layer thickness per pass (μm/pass).

The invention claimed is:

1. A roll for use in a machine for at least one of producing or further processing a fibrous paper, board or tissue web, the roll comprising:

a roll shell having at least some sections formed of a metal material;

a coating formed on said roll shell, said coating having a layer thickness;

said coating being formed of at least one of a metallic, ceramic or cermet material or at least some sections of said coating including a metallic, ceramic or cermet material; and an alloy region formed between said roll shell and said coating, said alloy region having a thickness of 0.5 to 3% of said layer thickness of said coating;

said roll shell, said coating and said alloy region forming the roll for producing or further processing a fibrous paper, board or tissue web.

2. The roll according to claim 1, wherein said alloy region has a thickness of 1% of a layer thickness of said coating.

3. The roll according to claim 1, which further comprises a metallurgical connection between said material of said coating and said material of said roll shell in said alloy region.

4. The roll according to claim 1, wherein said coating is produced by an inductive device, a plasma gun or a laser.

5. The roll according to claim 1, wherein said material of said coating is in a powder form, a wire form or a rod form.

6. The roll according to claim 1, wherein said coating has at least one layer.

7. The roll according to claim 6, wherein said at least one layer is produced by a single pass.

8. The roll according to claim 1, wherein said coating has a plurality of layers.

9. The roll according to claim 8, wherein said plurality of layers are produced by a plurality of passes.

10. A method for producing a roll for use in a machine for at least one of producing or further processing a fibrous paper, board or tissue web, the method comprising the following steps:

providing a roll shell having a surface and at least some sections formed of a metal material;

using an application device having material feed and an energy source to apply a coating on the surface of the roll shell by laser cladding while applying thermal energy to partially melt the surface of the roll shell and form an alloy region with a metallurgical connection of the material of the roll shell and the material of the coating;

providing the alloy region with a thickness of 0.5 to 3% of a layer thickness of the coating; and forming the coating of at least one of a metallic, ceramic or cermet material or forming at least some sections of the coating of a metallic, ceramic or cermet material to provide the roll for producing or further processing a fibrous paper, board or tissue web.

11. The method according to claim 10, which further comprises forming the laser cladding coating in a plurality of passes partially melting and producing further alloy regions between layers of the coating.

12. The method according to claim 10, which further comprises rotating the roll shell during the step of applying the coating to the roll shell.

13. The method according to claim 12, which further comprises moving the application device while the roll shell is rotating.

14. The method according to claim 10, which further comprises carrying out the step of applying thermal energy by directly applying a laser beam provided by the energy source of the application device to the roll shell.

* * * * *